United States Patent [19]

Ushiro et al.

[11] 4,404,997

[45] Sep. 20, 1983

[54] WASTE BINDING YARN TAKE-UP DEVICE FOR SHUTTLELESS LOOM

[75] Inventors: Masayuki Ushiro, Tokyo; Takeki Tsubokura, Koganei, both of Japan

[73] Assignee: Nissan Motor Co., Ltd., Yokohama, Japan

[21] Appl. No.: 253,569

[22] Filed: Apr. 13, 1981

[30] Foreign Application Priority Data

Apr. 12, 1980 [JP] Japan ..... 55-47479

[51] Int. Cl.[3] ..... D03D 49/00

[52] U.S. Cl. ..... 139/291 R; 139/302; 139/304; 139/430; 242/18 DD

[58] Field of Search ..... 139/304, 305, 309, 291 R, 139/291 C, 302, 303, 430; 242/18 DD

[56] References Cited

U.S. PATENT DOCUMENTS

| | | | |
|---|---|---|---|
| 2,914,904 | 12/1959 | Brown | 242/18 DD |
| 3,297,057 | 1/1967 | Mizuno et al. | 139/291 C |
| 3,441,231 | 4/1969 | Siegel | 242/18 DD |
| 3,461,920 | 8/1969 | Sakamoto | 139/302 |
| 3,640,477 | 2/1972 | Fürst | 242/18 DD |

FOREIGN PATENT DOCUMENTS

| | | | |
|---|---|---|---|
| 1391054 | 1/1965 | France | 242/18 DD |

*Primary Examiner*—James Kee Chi

*Attorney, Agent, or Firm*—Thompson, Birch, Gauthier & Samuels

[57] ABSTRACT

A waste binding yarn take-up device for a shuttleless loom, comprises a traction device for pulling waste binding yarns at a constant traction speed, a rotary traverse roller rotatable at a peripheral velocity slightly higher than the traction speed of the traction device, and formed at its outer surface with a guide groove along which the waste binding yarns from the traction device is guided to make traverse motion thereof, and a rotatable core member on which a cheese of the waste binding yarns from the traverse roller is capable of being formed, the core member being biased so that the outer surface of the cheese contacts the outer surface of the traverse roller, thereby wounding up the waste binding yarns on the core member, holding in tension the waste binding yarns without causing the slackening of the waste binding yarns.

9 Claims, 5 Drawing Figures

WASTE BINDING YARN TAKE-UP DEVICE FOR SHUTTLELESS LOOM

BACKGROUND OF THE INVENTION

This invention relates to a shuttleness loom, and more particularly to a device for taking up waste binding yarns, holding a picked weft yarn in tension, which waste binding yarns will be used as a particular thread for weaving a particular fabric.

In conventional shuttleness looms, the end portion of a picked weft yarn, remaining projecting from the edge of a woven fabric, is caught by a plurality of binding yarns (or catch-cords) which repeat their shed opening and closing actions and are positioned at a side of the array of warp yarns which side is opposite to another side at which a weft inserting nozzle is positioned. The binding yarns, after having caught the weft yarn end are twisted all together so as to securely keep and pull the weft yarn end portion to hold the picked weft yarn in tension. Even after trimming off the weft yarn end portion adjacent the side edge of a woven fabric, the binding yarns remaining caught with the picked weft yarn end portions (referred to as "waste binding yarns" hereinafter) are pulled at a speed which is same as or higher than the moving speed of the woven fabric to be introduced to a take-up device therefor. This pulling action of the waste binding yarns is accomplished by putting the waste binding yarns between a pair of rotatable gears or rollers, in which the waste binding yarns are dropped by its weight into an accumulator container or wound up on a binding frame after passing through the gears to be dumped.

The above-mentioned waste binding yarns remainng caught with the trimmed weft yarn ends are in the shape of a caterpillar. Such waste binding yarns accumulated in the container have been usually dumped about twice a day. In this connection, with a winder in which the waste binding yarns are wound up on the winding frame, when the winding frame itself is rotated in direct connection with a rotatable shaft to uniformly wind up thereon the waste binding yarns under traverse motion of the waste binding yarns, a difficulty has been encountered in which the peripheral velocity of the wound waste binding yarns increases with the increase in diameter thereof. Accordingly, it will be considered effective to wind up the waste binding yarns under weak tension which is obtained by slipping between a belt and a pulley, so as to aborb the difference in speed between waste binding yarn supply and waste binding yarn winding up on the winding frame. However, this is effective only when the diameter of the wound waste binding yarns is smaller, but not effective when the same diameter has been larger. Because, the speed difference between the waste binding yarn supply and the waste binding yarn winding up cannot be absorbed only by slipping between the belt and the pulley when the diameter of the wound waste binding yarn is larger. As a result, a serious problem has been encountered in which an excessive high tension is imparted to the waste binding yarns, thereby resulting in the undesirable cutting of the waste binding yarns.

Additionally in case where an adhesive is attached onto the binding yarns, such binding yarns may be continuously undesirably stuck on the surface of teeth of the gear and accordingly wound on the gears. This prevents good operation of a waste binding yarn take-up device. In order to avoid such a disadvantage, it is necessary to provide a vibrator incorporated with the waste binding yarns drawn from the pair of gears for imparting vibration to it, or various devices for further pulling the waste binding yarns from the gears.

BRIEF SUMMARY OF THE INVENTION

A waste binding yarn take-up device according to the present invention comprises a traction device for pulling waste binding yarns at a constant traction speed, which yarns are in the form of a thread and remains catching picked weft yarn ends, a traverse roller rotatable at a peripheral velocity slightly higher than the traction speed of the traction device, and formed at the outer surface thereof with a guide groove along which the waste binding yarns from the traction device are guided to make traverse motion thereof, and a rotatable core member on which a cheese of the waste binding yarns from the traverse roller is capable of being formed, the rotatable core being so biased that the cheese contacts the outer surface of the traverse roller.

With this arrangement, the waste binding yarns can be wound up on the core member until a larger diameter cheese is formed thereon, holding in tension the waste binding yarns between the traction device and the traverse roller without causing a slackening of the waste binding yarns. This can overcomes the above-mentioned serious drawbacks encountered in conventional waste binding yarn treating devices. Additionally, in view of the fact that the waste binding yarns wound on the core member is a particular thread catching short yarns or cut weft yarn end portions, it is very advantageous to use such a particular thread as materials for weaving a fabric particular in touch and appearance, from a stand point of making efficient use of the waste material.

BRIEF DESCRIPTION OF THE DRAWINGS

The features and advantages of the waste binding yarn take-up device according to the present invention will be more clearly appreciated from the following description taken in conjunction with the accompanying drawings in which the same reference numerals designate the same parts and elements, and in which.

DETAILED DESCRIPTION OF THE INVENTION

Figure 1:
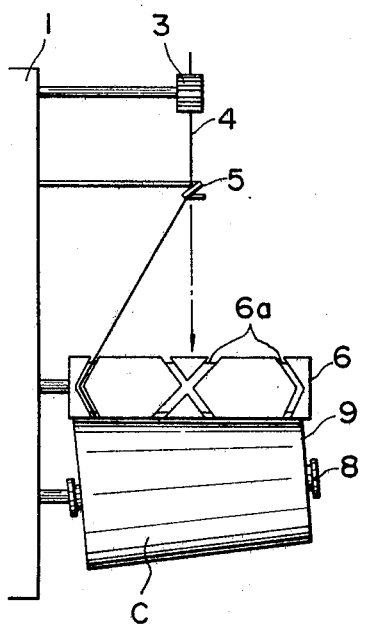
FIG. 1 is a diagrammatic view illustrating the principle of a waste binding yarn take-up device according to the present invention.
Figure 2:
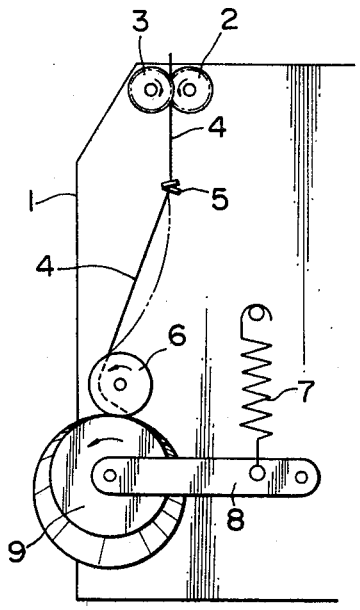
FIG. 2 is a side view of the take-up device of FIG. 1.

Referring now to FIGS. 1 and 2 of the drawings, the principle of a waste binding yarn take-up device for use in a shuttleness loom, according to the present invention will be illustrated.

According to the present invention, the loom is equipped at the upper section of the frame thereof with a pair of gears 2 and 3 which constitute a traction device for pulling so-called waste binding yarns (catch-cords) 4 at a constant speed, keeping the false selvage therebetween. The waste binding yarns means a plurality of twisted binding yarns, in the form of a single thread, remaining caught with the cut end portions of picked weft yarns, each end portion remaining projecting from the edge of a woven fabric. The thus pulled waste binding yarns 4 are guided through a yarn guide 5 onto the surface of a rotary traverse roller 6. The traverse roller 6 is formed at its surface with a guide groove 6*a* along which the waste binding yarns 4 are guided, the groove 6*a* crossing as shown in FIG. 1. The traverse roller 6 is constructed and arranged to rotate at a peripheral velocity slightly higher than the waste binding yarn traction speed by the traction device, which traction speed corresponds to the moving speed of the waste binding yarns passing through between the gears 2 and 3. The peripheral velocity of the traverse roller 6 is, for example, 1.2 to 1.5 times the waste binding yarn traction speed. The traverse roller 6 forms part of a so-called rotary traverse winder. The loom is further equipped with a frusto-conical core pipe or member 9 urged to be contactable with the surface of the traverse roller 6 by means of a spring 7 so as to be rotatable with the traverse roller 6, so that the waste binding yarns 4 are wound up to form a cheese C thereof on the outer surface of the core member 9. The frusto-conical core member 9 is detachable relative to a support member 8. With above-discussed arrangement, the waste binding yarns 4 are wound up on the surface of the frusto-conical core member 9 to form the cheese C on the core member, under its traverse motion in which it is reciprocally moved rightward and leftward on the surface of the frusto-conical core member 9 by virtue of the guide groove 6*a* of the traverse roller 6.

Figure 3:
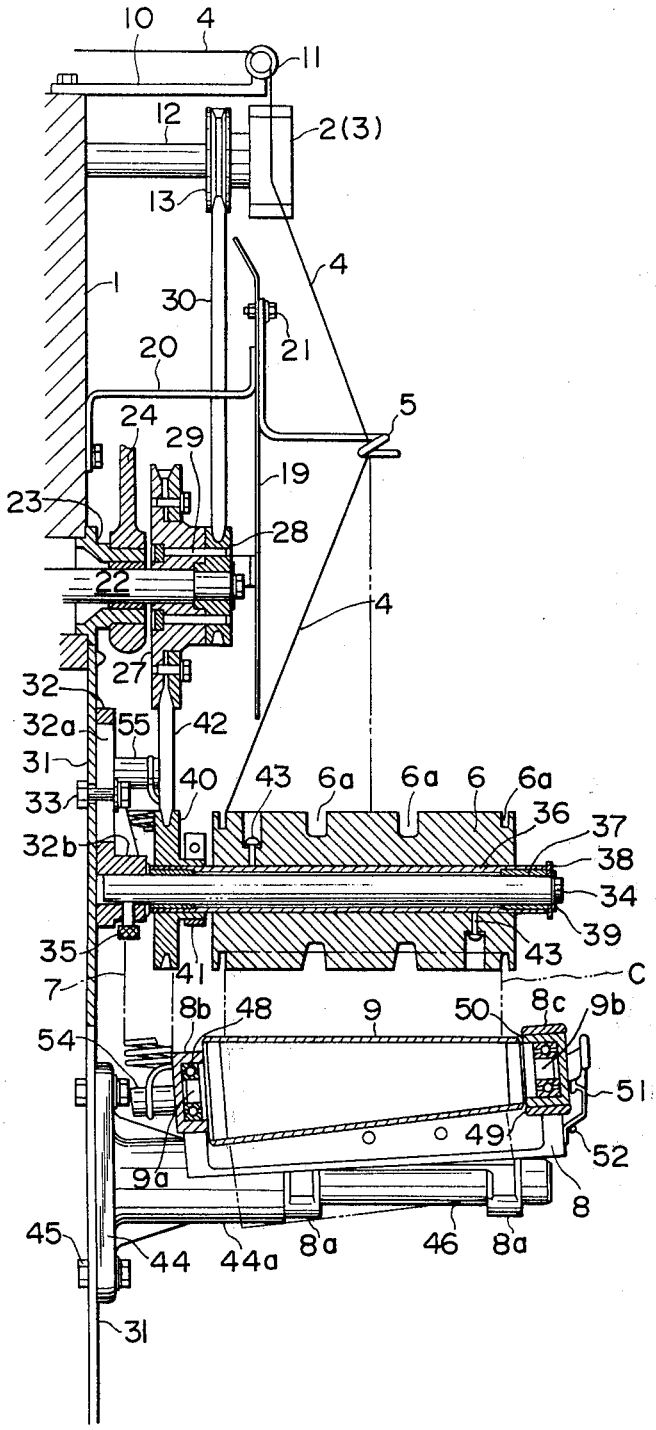
FIG. 3 is a sectional front elevation of a preferred embodiment of the waste binding yarn take-up device in accordance with the present invention.
Figure 4:
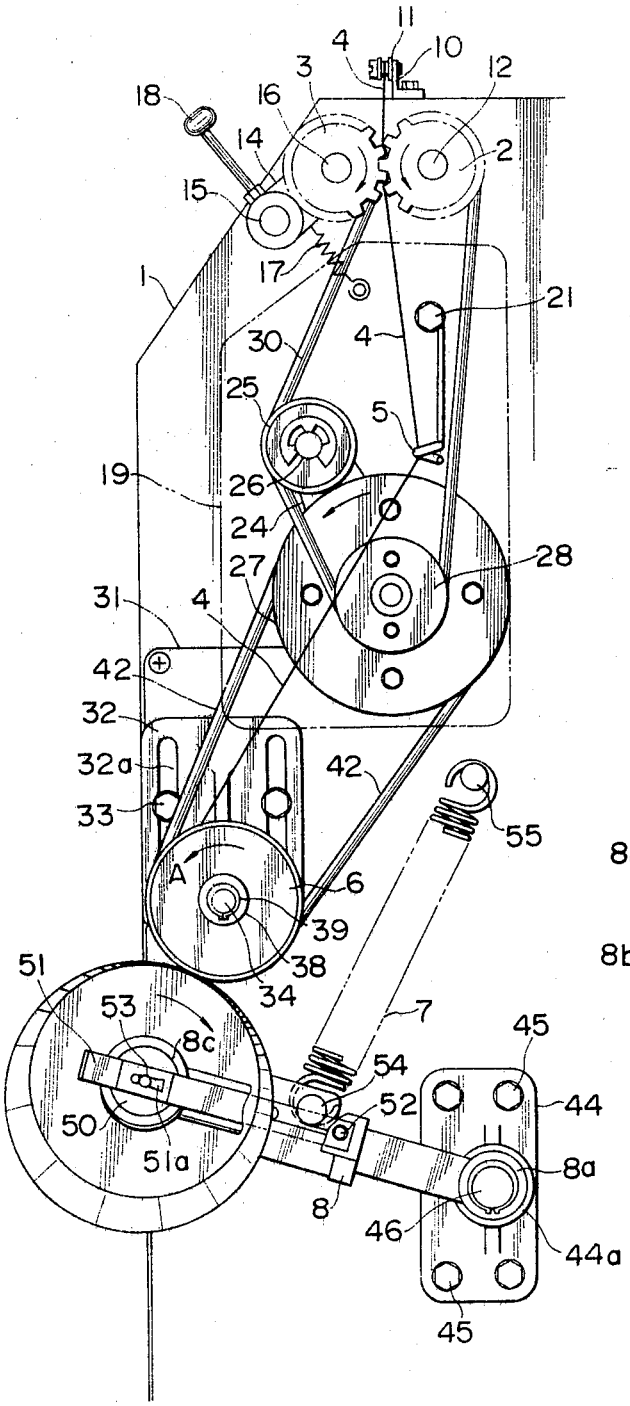
FIG. 4 is a side elevation of the take-up device of FIG. 3.
Figure 5:
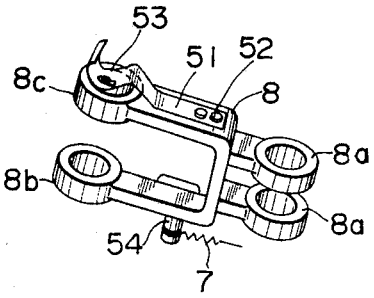
FIG. 5 is a perspective view of a support member for a frusto-conical core member of the take-up device of FIG. 3.

Reference is now made to FIGS. 3, 4 and 5, wherein preferred embodiment of the waste binding yarn take-up device according to the present invention is illustrated in which the same reference numerals as in FIGS. 1 and 2 designate the same part and elements.

In this embodiment, the shuttleness loom is provided at the upper section of the frame 1 thereof with a bracket 10 which laterally extends and rotatably carrys a roller 11 at its free end. The roller 11 functions to guide the waste binding yarns 4 toward the pair of gears 2 and 3 which are positioned below the roller 11. The gear 2 is rotatably mounted on a stationary shaft 12 projected from the frame 1. A pulley 13 is formed integrally with the gear 2 and rotatably mounted on the shaft 12. A swingable arm 14 is pivoted through a stud 15 and rotatably carry at its free end the gear 3. The gear 3 is always biased against the gear 2 by means of a spring 17 and can be separated from the gear 2 by means of a lever 18 fixed to the base section of the swingable arm 14. The reference numeral 19 designates a belt cover which is securely supported through a bracket 20 on the frame 1. The yarn guide 5 is secured on the surface of the belt cover 19 by means of a bolt 21.

A rotatable prime mover shaft 22 passes through the frame 1 and is rotatably supported by a bearing 23 attached on the frame 1. A tension pulley support arm 24 is fixed on the outer surface of the bearing 23. The support arm 24 rotatably carries at its free end a tension pulley 25 for imparting a tension to a V-belt 30 which will be discussed later. As shown, the tension pulley 25 is pivoted through a stud 26 on the support arm 24. The rotatable prime mover shaft 22 fixedly carries at its free end a pulley 27 for driving the traverse roller 6 and a pulley 28 for driving the gear 2, in which the both the pulleys 27, 28 are securely connected with each other as a single unit by means of bolts 29 each of which has a hexagonal hole at its head. The V-belt 30 passes around both pulleys 13 and 28.

A winder base 31 is secured onto the frame 1. A bracket 32 is fixed on the winder base 31 through its elongate openings 32*a* by means of bolts 33. The bracket 32 is formed with a cylindrical boss section 32*b* into which an end section of a stationary shaft 34 is inserted and fixed by means of a bolt 35. A rotatable pipe member 36 is rotatably mounted through a bushing 37 on the surface of the stationary shaft 34. The reference numerals 38 and 39 designate a washer and a snap ring, respectively. A pulley 40 is mounted on the pipe member 36 at the end section close to the frame 1 and fastened by means of a fastening band 41 on the surface of the pipe member 36. A V-belt 42 is passed around both the pulleys 27 and 40. The traverse roller 6 is mounted on the surface of the pipe member 36 and fixed relative to the pipe member 36 by means of small screws 43. The traverse roller 6 is as stated above formed at its outer surface with the guide groove 6*a* which having a X-shaped crossing section as shown in FIG. 1 and so formed that the waste binding yarns 4 guided on the surface of the traverse roller 6 carries out its reciprocal movement along the axis of the traverse roller 6, which causes the traverse motion of the waste binding yarn 4 to be drawn from the traverse roller 6.

A bracket 44 is securely supported on the winder base 31 and formed with a boss section 44*a* into which a stationary shaft 46 is securely inserted. The support member 8 is formed, as best seen from FIG. 5, in the generally H-shape and formed at its lower ends with boss sections 8*a* which are rotatably mounted on the stationary shaft 46 so that the free or upper ends of the support member 8 are swingable. The support member 8 is formed at the free end close to the frame 1 with a cylindrical bearing receiving section 8*b* with a closed bottom, and at another free end with another cylindrical bearing receiving section 8*c* without a closed bottom. The frusto-conical core member 9 is contactable with the surface of the traverse roller 6 and rotatable with the roller 6. One end section 9*a* of a shaft of the frusto-conical member 9 is rotatably supported through a bearing 48 within the bearing receiving section 8*b*. Another end section 9*b* of the shaft of the frusto-conical core member 9 is rotatably supported through a bearing 49 within a casing 50 disposed between the inner surface of the cylindrical bearing receiving section 8*c* and the outer surface of the bearing 49. Accordingly, the frusto-conical core member 9 is rotatably and detachably supported relative to the supporting member 8. Additionally, a plate spring 51 is fixed at its one end on the side surface of the support member 8 by means of a bolt 52 so as to prevent the casing 50 from escaping from its position. The plate spring 51 is formed at its free end with an elongate opening 51*a* for receiving a stationary pin 53 securely planted on the casing 50. The support member 8 is provided at its side close to the frame 1 with a pin 54 which projects toward the frame 1. The spring 7 is disposed between the pin 54 and a pin 55 planted on the base 31 to bias the frusto-conical core member 9 to allow the cheese C on the member 9 to contact the traverse roller 6.

The manner of operation of the above-discussed take-up device will be explained hereinafter.

The waste binding yarns 4 like a single thread is pulled at a constant speed by the pair of gears 2 and 3, and thereafter introduced through the stationary yarn guide 5 onto the outer surface of the traverse roller 6 which is driven in the direction of an arrow in FIG. 4 through the prime mover shaft drive pulley 27, the belt 42, the driven pulley 40, and the rotatable pipe member 36. The waste binding yarns thus introduced on the traverse roller outer surface are reciprocally moved rightward and leftward along the axis of the traverse roller 6. Since frusto-conical member 9 is biased so that core member 9 itself or cheese C contact the outer surface of the traverse roller 6 by means of the spring 7. The frusto-conical core member 9 with the cheese C thereon rotates under friction with the traverse roller 6, so that the waste binding yarns 4 under the traverse motion are wound up on the surface of the frusto-conical core member 9. It is to be noted that the moving speed of the binding yarns 4 which are being wound up on the frusto-conical core member 9 is always constant regardless of the variation of the radius of the cheese C formed on the member 9, because the frusto-conical core member 3 rotates in contact with the traverse roller 6.

It is to be noted that a technique using a conventional rotary traverse winder has usually encountered the following problems: In case where binding yarns are wound up by the winder at the same speed as the speed at which the binding yarns are drawn from pair of gears (2 and 3), when the binding yarns move from the end section to the central section of a traverse roller (6), the distance through the binding yarns between the gears (2 and 3) and the traverse roller (6) becomes lesser and therefore the binding yarns are slackened, thereby preventing good traverse motion of the waste binding yarns.

On the contrary, according to the present invention, the waste binding yarn take-up device is constructed and arranged so that the peripheral velocity of the traverse roller 6 is 1.2 to 1.5 times the traction speed of the winding yarns by the gears 2 and 3 of the traction device. This can effectively absorb binding yarns sluckening which has been encountered in the conventional rotary traverse winder. As appreciated from the above, according to the present invention, the frusto-conical core member 9 rotates in contact with the traverse roller 6, and additionally the binding yarns guided through the guide groove 6*a* receive the traverse motion and are uniformly dispersed on the whole outer surface of the frusto-conical core member 9. As a result, the binding yarns can be wound up in a uniform thickness on the frusto-conical core member 9. Moreover, since the peripheral velocity of the traverse roller 6 is set at a value slightly higher than the traction speed of the winding yarns by the traction device 2 and 3, the binding yarn slacking due to the traverse motion thereof can be absorbed and consequently there is no fear of causing, for example, attachment of the binding yarns onto the surface of the gears 2 and 3. Furthermore, even when the diameter of the cheese C formed on the frusto-conical core member 9 increases, the peripheral velocity of the cheese does not vary since the frusto-conical core member 9 is driven by the traverse roller 6. As a result, the binding yarns can be wound up on the frusto-conical core member 9 until the diameter of the cheese becomes larger.

It will be understood that the cheese formed on the frusto-conical core member 9 can be easily taken off by removal of the frusto-conical core member 9 from the waste binding yarn take-up device, which removal is accomplished by first sliding the casing 50 rightward in FIG. 3 against the bias of the plate spring 51, secondly removing the shaft left end section 9*a* from the bearing 48, and lastly removing the shaft right end section 9*b* from the bearing 49.

Thus, according to the present invention, the binding yarns 4 can be wound up as a large diameter cheese and therefore such a cheese can be used as a particular thread for weaving a fabric particular in touch and appearance. Additionally, the waste binding yarns removing operation which has been conventionally taken place about twice a day can be replaced with the above-mentioned easy removing operation of the frusto-conical core member 9 taken place about once a week. Therefore, the operation efficiency of such a shuttleness loom can be considerably improved.

What is claimed is:

1. A waste binding yarn take-up device for a shuttleness loom, comprising:
   - traction means for pulling waste binding yarns at a constant traction speed;
   - a rotary traverse roller formed at the outer surface thereof with a guide groove along which said waste binding yarns from said traction means are guided, the said guide groove being arranged to impart a traversing motion to said yarns;
   - means for rotating said traverse roller at a peripheral velocity slightly higher than the traction speed of said traction means;
   - a rotatable core member on which the waste binding yarns from said traverse roller is capable of being wound; and
   - means for biasing said rotatable core member and the waste binding yarns wound thereon into contact with said traverse roller.

2. A waste binding yarn take-up device as claimed in claim 1, further comprising a yarn guide through which the waste binding yarns from said traction means are guided onto said traverse roller.

3. A waste binding yarn take-up device as claimed in claim 1, wherein said traction means includes a pair of driven gears between which the waste binding yarns are put.

4. A waste binding yarn take-up device as claimed in claim 3, wherein said traverse roller is rotatably mounted on a stationary shaft whose axis is parallel with the axes of said gears of said traction means.

5. A waste binding yarn take-up device as claimed in claim 4, wherein said traverse roller rotating means includes a rotatable prime mover shaft whose axis is parallel with the axis of said stationary shaft for said traverse roller, a first drive pulley securely mounted on said rotatable prime mover shaft, a first driven pulley rotatably mounted on said stationary shaft and rotatable with said traverse roller as a single unit, and a belt connecting said first drive pulley and said first driven pulley.

6. A waste binding yarn take-up device as claimed in claim 5, said traction means includes means for rotating said pair of gears, said gear rotating means including a second drive pulley securely mounted on said rotatable prime mover shaft, a second driven pulley rotatable with one of said pair of gears as a single unit, and a belt connecting said second drive pulley and said second driven pulley.

7. A waste binding yarn take-up device as claimed in claim 1, wherein said traverse roller rotating means rotates said traverse roller at a peripheral velocity of a range from 1.2 to 1.5 times the traction speed of said traction means.

8. A method of taking up a waste binding yarn in a shuttleness loom, comprising the following steps of:

pulling waste binding yarns at a constant traction speed by using a traction device;

imparting traverse motion to said waste binding yarns from said traction device by using a rotary traverse roller;

rotating said traverse roller at a peripheral velocity slightly higher than said traction speed of said traction device; and winding up said waste binding yarns from said traverse roller to form a cheese on a rotatable core member which is biased to be contactable with said traverse roller.

9. A method for taking up a waste binding yarns in a shuttleness loom of the type including a traction device of pulling the waste binding yarns, a rotary traverse roller formed at the outer surface thereof with a guide groove along which the binding yarns from the traction device are guided to make traverse motion thereof, and a rotatable core member on which a cheese of the waste binding yarns from the traverse roller can be formed, the core member being biased to be contactable with the traverse roller, said method comprising the following steps of:

operating the traction device to pull said waste binding yarns at a constant traction speed; and rotating the traverse roller at a peripheral velocity slightly higher than the traction speed of the traction device.

* * * * *

UNITED STATES PATENT AND TRADEMARK OFFICE

CERTIFICATE OF CORRECTION

PATENT NO. : 4,404,997
DATED : September 20, 1983
INVENTOR(S) : M. Ushiro and T. Tsubokura It is certified that error appears in the above-identified patent and that said Letters Patent are hereby corrected as shown below:

In Claim 1, column 6, lines 17-18, cancel "shuttleness" and insert --shuttleless--

In Claim 8, column 7, line 4, cancel "shuttleness" and insert --shuttleless--

In Claim 9, column 8, line 2, cancel "shuttleness" and insert --shuttleless--

Signed and Sealed this

*Thirteenth* Day of *December 1983*

[SEAL]

*Attest:*

GERALD J. MOSSINGHOFF

*Attesting Officer*

*Commissioner of Patents and Trademarks*